US006727793B2

(12) United States Patent
Piechnick

(10) Patent No.: US 6,727,793 B2
(45) Date of Patent: Apr. 27, 2004

(54) LOW-POWER TRANSFORMER FOR PRINTED CIRCUIT BOARDS

(75) Inventor: John Joseph Piechnick, Pasig (PH)

(73) Assignee: Astec International Limited, Kwun Tong (HK)

( * ) Notice: Subject to any disclaimer, the term of this patent is extended or adjusted under 35 U.S.C. 154(b) by 0 days.

(21) Appl. No.: 09/934,978

(22) Filed: Aug. 21, 2001

(65) Prior Publication Data

US 2003/0038700 A1 Feb. 27, 2003

(51) Int. Cl.[7] ..... H01F 27/30
(52) U.S. Cl. ..... 336/198
(58) Field of Search ..... 336/65, 83, 84 R, 336/84 C, 90, 92, 98, 198, 196, 200, 232

(56) References Cited

U.S. PATENT DOCUMENTS

| | | | | |
|---|---|---|---|---|
| 3,750,072 A | | 7/1973 | Weiner | |
| 4,000,483 A | | 12/1976 | Cook et al. | |
| 4,234,865 A | * | 11/1980 | Shigehara | 336/92 |
| 4,405,913 A | | 9/1983 | Finkbeiner | |
| 4,549,130 A | | 10/1985 | Dobberstein | |
| 4,716,394 A | | 12/1987 | Gordon | |
| 4,857,878 A | | 8/1989 | Eng, Jr. et al. | |
| 4,939,623 A | | 7/1990 | Equi et al. | |
| 4,977,301 A | * | 12/1990 | Maehara et al. | 336/84 C |
| 4,980,664 A | | 12/1990 | Harwood | |
| 4,988,968 A | | 1/1991 | Tochio et al. | |
| 5,010,314 A | | 4/1991 | Estrov | |
| 5,321,572 A | | 6/1994 | Shibui et al. | |
| 5,726,616 A | | 3/1998 | Bell | |
| 5,783,982 A | | 7/1998 | Lecheler | |
| 5,996,214 A | | 12/1999 | Bell | |
| 6,008,712 A | | 12/1999 | Tokuda et al. | |
| 6,344,786 B1 | * | 2/2002 | Chin | 336/198 |

FOREIGN PATENT DOCUMENTS

DE 0097599 * 1/1984

* cited by examiner

*Primary Examiner*—Tuyen T. Nguyen
(74) *Attorney, Agent, or Firm*—Coudert Brothers LLP

(57) ABSTRACT

A low-power planar transformer for cell phone chargers or the like includes a primary bobbin structure carrying connection pins aligned for mounting the transformer in a through-hole configuration or directly on a circuit board, and a secondary bobbin structure that fits wholly within the primary bobbin structure.

6 Claims, 2 Drawing Sheets

LOW-POWER TRANSFORMER FOR PRINTED CIRCUIT BOARDS

FIELD OF THE INVENTION

This invention relates to low-power transformers for use in cell phone chargers or the like, and more particularly to a planar transformer suitable for installation on a printed circuit board in miniaturized electronic equipment.

BACKGROUND OF THE INVENTION

Power supplies for miniaturized electronic equipment such as cell phone chargers typically involve converter circuits, such as, for example, flyback converters, that require a very low-power (2–3 watts) transformer for their operation. Because of the space constraints in such equipment, the transformer is typically a limiting factor in the power supply design. Inasmuch as the power supply usually takes the form of a low-profile printed circuit board, it is desirable to make the transformer as small and flat, or planar, as possible, and to so arrange its pins that it can either be mounted in a through-hole configuration or soldered directly to pads on the board.

The present invention is an improvement over my copending application Ser. No. 09/545,367 filed Apr. 7, 2000 and assigned to the assignee of this application. In that application, I disclosed a transformer construction in which the primary and secondary winding bobbin structures are positioned one above the other in the axial direction (i.e., a direction perpendicular to the plane of the transformer on each side of an electrostatic shield). The construction of the '367 application is relatively flat when mounted to an edge of a circuit board, but loses that advantage when mounted in a through-hole configuration by pins. It is therefore desirable to provide a transformer that can be mounted on a circuit board by pins yet lies as flatly against the board as possible.

SUMMARY OF THE INVENTION

The present invention fills the above-stated need by providing a transformer construction in which the secondary bobbin structure fits wholly inside the primary bobbin structure, yet is electrostatically shielded therefrom and so configured as to minimize creepage and leakage inductance between the primary and secondary windings. The primary bobbin structure and the secondary bobbin structure are also so configured as to easily snap together during assembly of the transformer and are light and sturdy enough to be impact-resistant if the power supply or the equipment using it is dropped.

Broadly stated, the present invention comprises a planar transformer for printed circuit boards, comprising: a primary bobbin structure; a secondary bobbin structure; and a core extendable through a central opening in each of said bobbin structures; wherein the primary bobbin structure includes a body surrounding said opening, a recess formed in said body around said opening, a primary bobbin supported by said body, and primary and secondary connection pins for mounting said primary bobbin structure on a circuit board; and wherein the secondary bobbin structure forms a secondary bobbin that is lockingly insertable into said recess so as to be contained therein.

DESCRIPTION OF THE PREFERRED EMBODIMENTS

Figure 1:
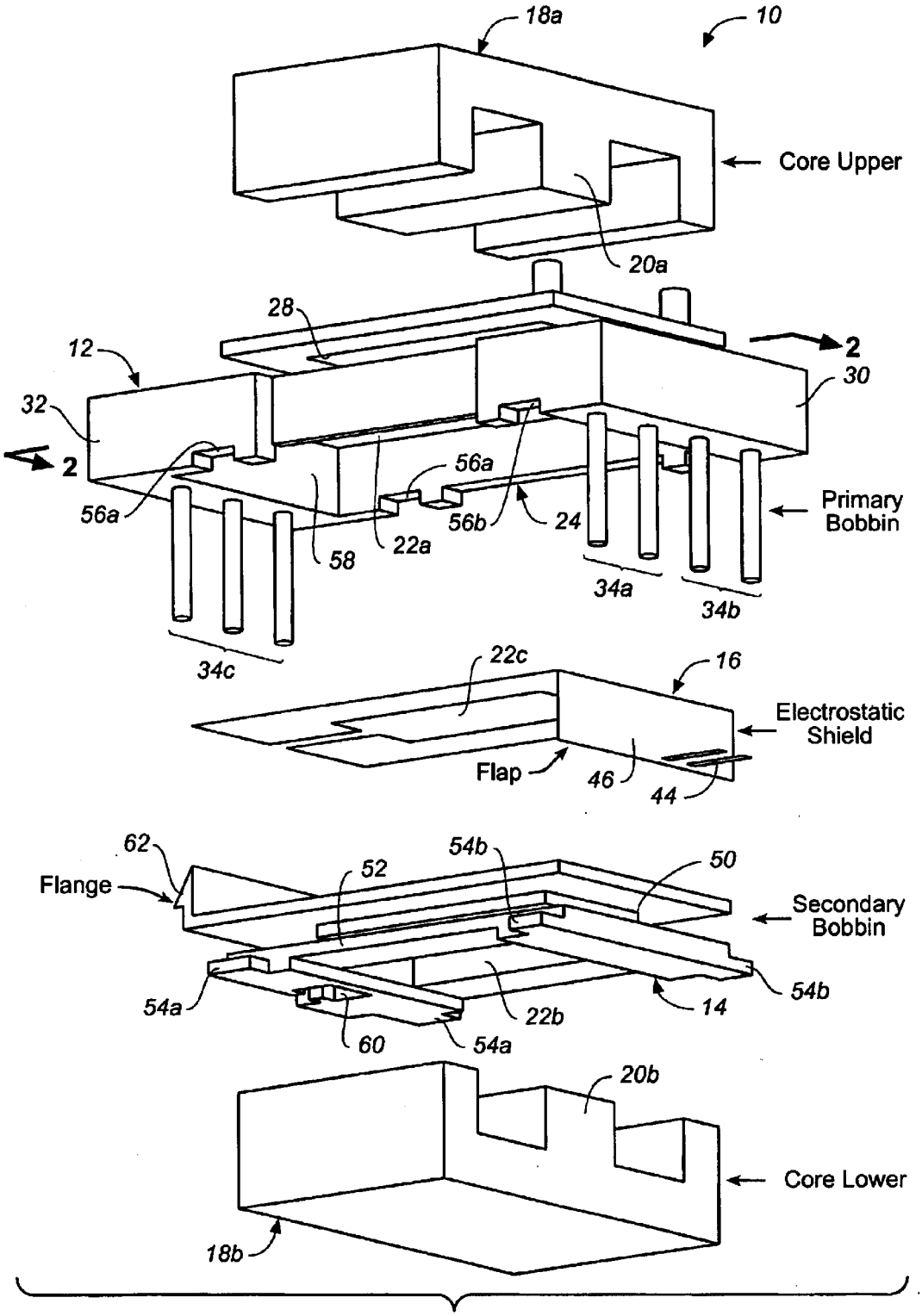
FIG. 1 is an exploded view of the transformer according to the present invention.

As best seen in FIG. 1, the transformer 10 of this invention is constructed of a primary bobbin structure 12, a secondary bobbin structure 14, and an electrostatic shield 16 interposed between them. A two-piece core 18*a*, 18*b* extends around the bobbins 12, 14 and has a central leg 20*a*, 20*b* that passes through a central opening 22*a*, 22*b* and 22*c* (see also FIGS. 2 and 3) formed, respectively, in bobbins 12, 14 and in the electrostatic shield 16.

The primary bobbin structure 12 includes a hollow body 24 which supports on its upper side a primary bobbin 28. The outer ends 30, 32 of the bobbin structure 12 are thickened to receive the contact pins 34*a*, 34*b* and 34*c* by which the transformer 10 is mounted to a circuit board 36 (FIGS. 2 and 3).

Figure 2:
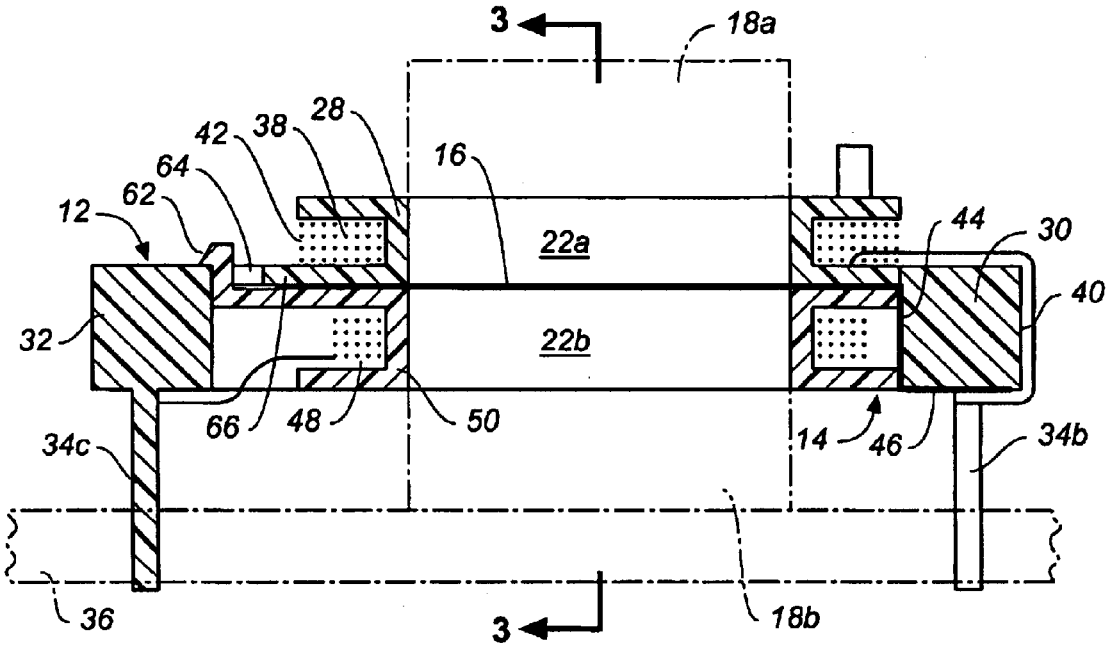
FIG. 2 is a vertical section of the assembled primary and secondary bobbin structures along line 2—2 of FIG. 1.
Figure 3:
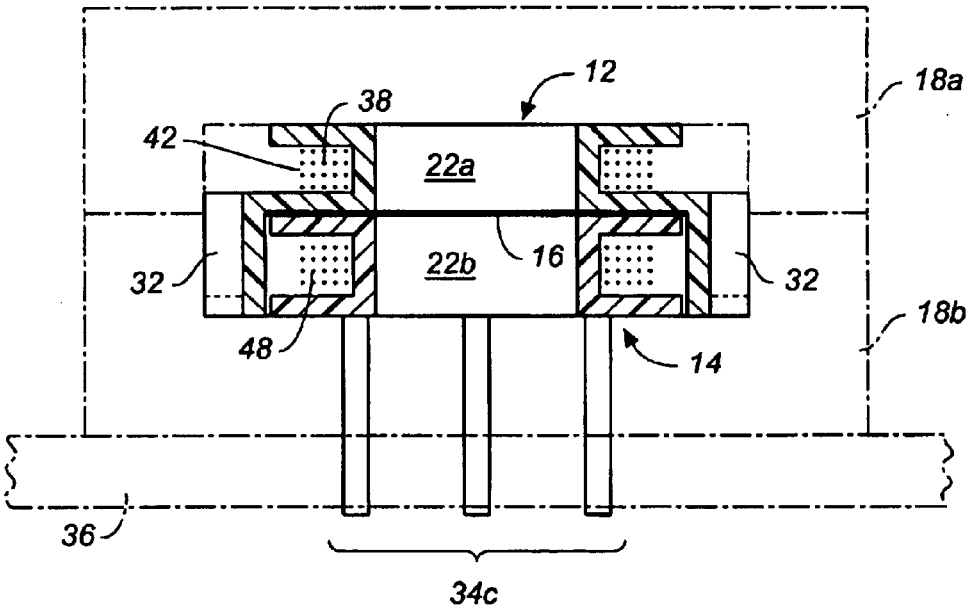
FIG. 3 is a vertical section along line 3—3 of FIG. 2.

The primary winding 38 of the transformer 10 (as seen in FIGS. 2 and 3) is wound about the primary bobbin 28. Its ends are brought around the edge 40 of the primary bobbin structure 12 and are attached to the pins 34*a*. The windings of the transformer 10 are preferably formed from triple insulated wire to provide adequate high voltage isolation. An auxiliary winding 42 such as the control winding for the flyback circuit, or "dummy" windings (windings terminated, only at one end, to a high frequency ground point on the primary winding to improve faraday shielding) may be wound over and/or under the primary winding 38 and may be connected to the pins 34*b*. One of the pins 34*b* may be the ground connection to which the prongs 44 of the flange 46 on the electrostatic shield 16 are connected.

The secondary winding 48 is wound on a secondary bobbin 50 which forms the central part of the secondary bobbin structure 14, and which surrounds the central opening 22*b*. The horizontal hollow flange 52 of the secondary bobbin 50 is equipped with lateral tabs 54*a*, 54*b* which clip into the clips 56*a*, 56*b* (FIG. 1) formed on the primary bobbin structure 12. The ends of the secondary winding 48 are attached to the pins 34*c* after the secondary bobbin structure 14 is assembled with the primary bobbin structure 12. It will be understood that other windings may also be wound on the secondary bobbin 50 as described above, or that the primary and secondary windings may be interchanged insofar as the circuit is concerned.

In the manufacture of the transformer 10, the primary winding 38 and any additional windings such as the auxiliary winding 42 are first wound onto the primary bobbin 28, and their ends are attached to the pins 34*a* and 34*b*. Next, the electrostatic shield 16 is inserted into the well or recess 58 of the primary bobbin structure, and its prongs 44 are engaged with one of the pins 34*b*.

The secondary winding or windings 48 are now wound onto the secondary bobbin 50, and their ends passed through the slot 60 (FIG. 1). The secondary winding structure 14 is now pushed up into the recess 58 until the tabs 54*a*, 54*b* clip into the clips 56*a*, 56*b* and the flange 62 of the structure 14 passes through the slot 64 of the primary bobbin structure 12 and locks onto it as shown in FIG. 2. The secondary bobbin structure 14 is now wholly contained within the recess 58 of the primary bobbin structure 12, and the winding ends protruding from slot 60 can be attached to the secondary pins 34*c*.

The winding ends and electrostatic shield prongs can now be dip-soldered onto their respective pins, and the two core halves 18*a* and 18*b* can be passed around and through the assembled primary and secondary structures, and joined together. A complete 2-watt transformer may be 25 mm×15 mm×9 mm in size.

Although the electrostatic shield 16 has been shown herein with the flange 46 on only one of the short sides of the shield 16, it will be understood that the construction of this invention allows the electrostatic shield 16 to have flanges 46 also on its two long sides, or even the sides defining the opening 22*c*, if this is desired.

The relatively large overhang of the bobbin flanges 66 is effective in reducing creepage. The relatively large winding area allows the use of fewer turns for winding, which makes the use of triple-insulated wire practical.

It will be appreciated that the inventive transformer construction has a number of advantages over the prior art. These include, among others, a low profile; a low primary-to-secondary capacitance to minimize "earth leakage" current; light weight to prevent circuit board breakage when dropped; small size for improved equipment miniaturization; and pin alignment for through-hole and surface mount of the transformer on the circuit board. Although only a preferred embodiment of the invention has been shown and described herein, it will be understood by those skilled in the art that the invention can be carried out in a variety of ways within the scope of the following claims.

What is claimed is:

1. A planar transformer for printed circuit boards, comprising:

a) a primary bobbin structure;

b) a secondary bobbin structure; and c) a core extendable through a central opening in each of said bobbin structures;

d) said primary bobbin structure having a body surrounding said opening, a recess formed in said body around said opening, a primary bobbin supported by said body, primary and secondary connection pins for mounting said primary bobbin structure on a circuit board, and a slot;

e) said secondary bobbin structure having a secondary bobbin surrounding said opening of said secondary bobbin structure and being shaped such that said secondary bobbin structure may be lockingly inserted into said recess so as to be, contained therein, and a hooked flange; wherein said secondary bobbin, when said secondary bobbin structure is inserted into said recess, is substantially coextensive with, and substantially parallel and adjacent to, said primary bobbin; and f) one or more primary and one or more secondary windings respectively wound about said primary and secondary bobbins;

wherein said hooked flange lockingly engages said primary bobbin structure through said slot when said secondary bobbin structure is fully inserted into said recess.

2. The transformer of claim 1, further comprising a substantially flat electrostatic shield interposed between said primary and secondary bobbins around said central opening.

3. The transformer of claim 1, in which said secondary bobbin structure forms a slot so as to provide access to said connection pins for said one or more secondary windings when said secondary bobbin structure is inserted into said recess.

4. The transformer of claim 1, in which said primary bobbin structure includes clips, and said secondary bobbin structure includes tabs, said tabs engaging said clips when said secondary bobbin structure is fully inserted into said recess.

5. The transformer of claim 1, wherein said bobbins include flanges that extend radially substantially beyond the windings formed thereon, so as to minimize creepage.

6. The transformer of claim 1, in which said primary and secondary connection pins are aligned so as to allow through-hole or direct mounting on a circuit board.

* * * * *